US005552956A

United States Patent [19]

Pasquarette et al.

[11] Patent Number: 5,552,956

[45] Date of Patent: Sep. 3, 1996

[54] ELECTRICAL EQUIPMENT HOUSING WITH A MOVABLE DOOR COVERING A KEYPAD AND HAVING A PUSHBUTTON FOR OPERATING A KEY WHEN THE KEYPAD IS COVERED BY THE DOOR

[75] Inventors: Ralph E. Pasquarette, Jordan; Alfred J. Gaskell, Hopkins, both of Minn.

[73] Assignee: Honeywell Inc., Minneapolis, Minn.

[21] Appl. No.: 289,871

[22] Filed: Aug. 12, 1994

[51] Int. Cl.[6] ..... H01H 3/12; H01H 13/14

[52] U.S. Cl. ..... 361/680; 200/343; 400/495

[58] Field of Search ..... 361/680, 683, 361/679, 724–727; 200/341, 343, 344, 345; 400/490, 492, 495, 496

[56] References Cited

U.S. PATENT DOCUMENTS

| | | | |
|---|---|---|---|
| 1,522,632 | 7/1894 | Walsh, Jr. | 200/343 |
| 2,761,936 | 9/1956 | Verkuil | 200/343 |
| 3,800,104 | 3/1974 | Lien et al. | 200/343 |
| 4,312,114 | 2/1982 | Monti, Jr. | 200/343 |
| 4,387,282 | 6/1983 | Latasiewicz | 200/343 |
| 4,456,802 | 6/1984 | Sutherland | 200/341 |
| 4,582,967 | 4/1986 | Brumit et al. | 200/343 |
| 5,350,244 | 9/1994 | Büttner | 400/496 |

*Primary Examiner*—Leo P. Picard
*Assistant Examiner*—Lynn D. Feild
*Attorney, Agent, or Firm*—Edward L. Schwarz

[57] ABSTRACT

A housing for electrical equipment such as an electronic thermostat has a panel in which is a keypad having a number of keys for manual entry of data, and a cover which can be moved into position to cover the keypad. The cover includes a pushrod which passes through a hole in the cover which is aligned with one of the keys while the cover covers the keypad. The pushrod is supported by a support arm assembly mounted on the cover surface at preselected mounting points and having a brace arm arranged to reduce stress on the mounting points and reduce friction and binding during operation. The topology of the pushrod, support arm assembly, cover, and a stop integral with the cover and which limits travel of the pushrod, cooperate to allow the pushrod and support arm assembly to be an integral unit and yet to be assembled to form the complete cover.

15 Claims, 2 Drawing Sheets

Fig. 1
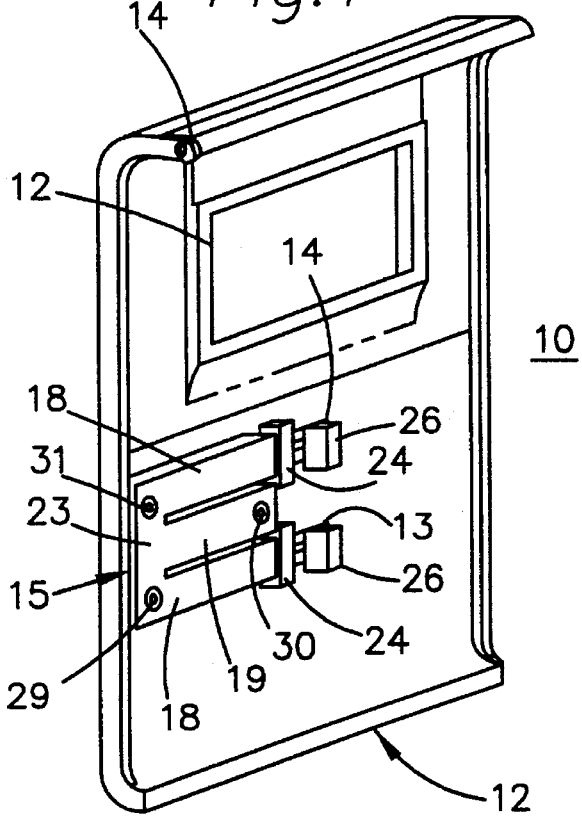
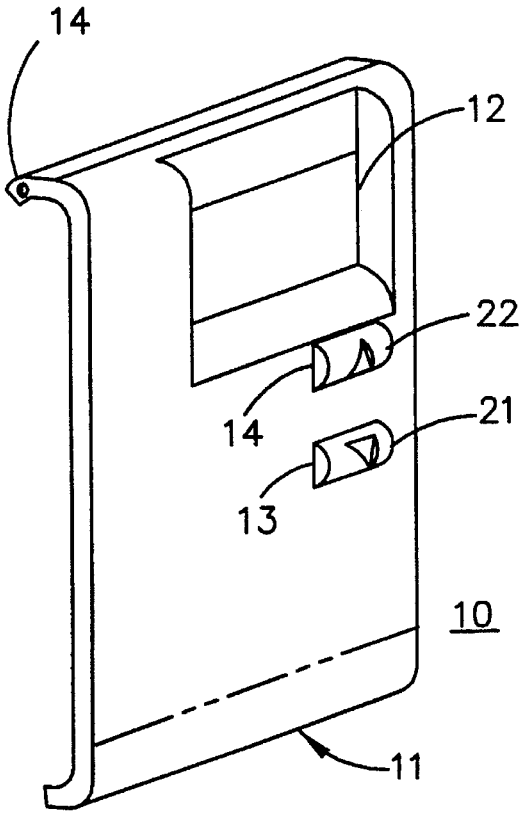
Fig. 2
Fig. 3
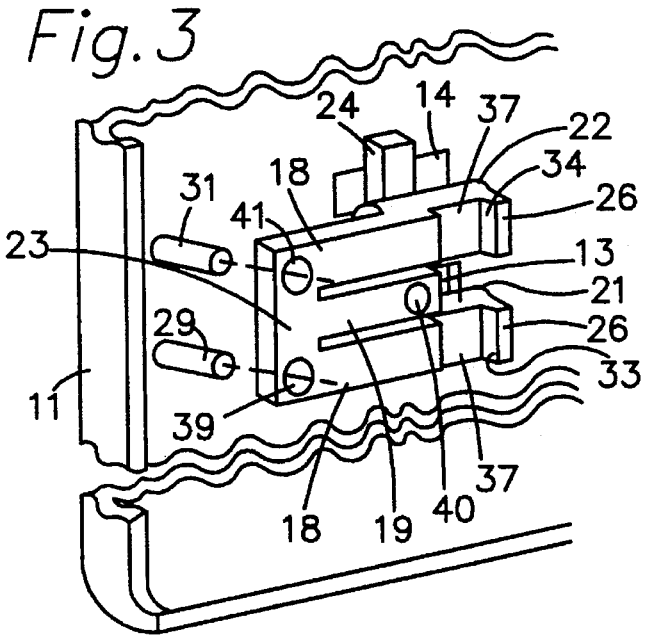
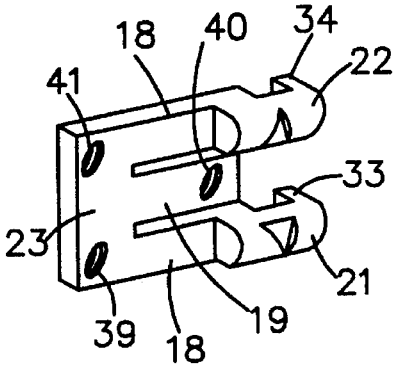
Fig. 4

ELECTRICAL EQUIPMENT HOUSING WITH A MOVABLE DOOR COVERING A KEYPAD AND HAVING A PUSHBUTTON FOR OPERATING A KEY WHEN THE KEYPAD IS COVERED BY THE DOOR

BACKGROUND OF THE INVENTION

Many types of electrical equipment require a human user to provide data to them for controlling their operation. Where the amount of control data is relatively small, the practice is often to provide a keypad which a human can manipulate to provide the needed control data. There are any number of examples of such keypads in our daily life, with those on telephones and calculators being perhaps the most common. These keypads are for the most part left to be accessible at all times. Keypads which are subjected to heavy use, such as those in calculators and telephones are usually of the button type. Another type of keypad such as is often found on microwave ovens, is of the membrane type where an area of a flexible membrane forms the operating surface of one key, and the switch is formed beneath the operating surface.

There are other situations, typically where there is only occasional need to access the keypad, where a cover is provided for the keypad. A cover may be provided perhaps for reasons of protecting the keypad, for controlling access to it, or simply for esthetics. Where a cover is provided, it may be desirable to allow access to one or more of the keys without moving the cover to expose the entire keypad. One situation may be to provide such an external access for the on/off switch. In another, the occupant may wish access to the set point control keys of an electronic thermostat without having to lift the cover, or in the dark, without having to turn on a light.

To accomplish this, it is convenient to provide an external pushbutton which is part of a pushrod accessible from outside the cover, and which can operate a key beneath the cover. Such a pushrod is supported in some way within an aperture or hole in the cover, where the aperture is in alignment with the key which is to be operated with the cover over the keypad. There are such pushrods at the present time which are supported in their aperture by a resilient cantilever support arm which is fastened to the interior surface of the cover. Pushing on the pushrod deflects the support arm and operates the key beneath the end of the pushrod. The resiliency of the support arm is arranged to hold the pushrod away from the key surface when the pushrod is not actively being pressed by a user.

There are a number of potential problem with these cantilever support arms. One is that operating the pushbutton creates an appreciable amount of tensile stress on the support arm's attachment point closer to the pushbutton. Since these housings are now usually made from some kind of thermoplastic or thermosetting plastic by an injection molding process, the material for the cover, the support arm, and the attachment between them are all preferably made from such a material. Such material is not renowned for its tensile strength, so the tensile stress which operating the pushbutton creates can cause failure of the support arm attachment to the interior of the cover.

The injection molding process is a cheap and reliable way of creating plastic parts with accurate dimensions. One rule of thumb when using this process is to limit the number of parts required for a complete unit of whatever device is involved. Another rule of thumb is to simplify the assembly process as much as possible. One common assembly expedient is to mold in the various parts, posts and holes into which the posts mate. Then after mating the posts with their corresponding holes, the projecting ends of the posts are staked to complete the step of attaching one part to another. Staked post assembly creates a final product whose parts are very strongly attached to each other when subjected to compressive and shear loads, but not so strongly attached when in tension, where the staked material provides a relatively small area in shear to resist tensile load.

These various competing engineering considerations may sometimes result in trade-offs in a design. All of these considerations are involved in designing a cover to be produced by injection molding and having external pushbuttons for operating a key of the keypad which it covers.

BRIEF DESCRIPTION OF THE INVENTION

We have developed a pushrod assembly which satisfies these engineering considerations in an efficient and effective manner. This assembly is intended for use with an electrical apparatus having a housing including a housing panel in which is mounted a keypad including a plurality of key surfaces each of which when pressed, closes a switch associated with the key surface. While this assembly was developed for use with a membrane keypad, it can also be used with a button keypad. A keypad cover is provided for covering the keypad. The cover has an interior surface and an exterior surface. The cover is to be mounted on the housing to be movable thereon from a first preselected position covering the keypad with the interior cover surface adjacent to and facing the key surfaces, to a second preselected position exposing the keypad and allowing access by a human user to the key surfaces thereof. In one embodiment, the keypad cover is mounted on the equipment housing for rotation between the first and second preselected positions. In another, the second preselected position may correspond to simply detaching the cover from the housing.

The keypad cover has an aperture in alignment with a preselected key surface when the keypad cover is in its first preselected position. The keypad cover including a pushrod assembly allowing at least one of the key surfaces to be pressed with the cover in its first preselected position covering the keypad. The pushrod assembly comprises a pushrod in the aperture and which projects from both the interior and exterior surfaces of the keypad cover. The pushrod itself has an external end surface on which the user exerts force and an interior end surface in alignment with the surface of the key to be operated by the pushrod. The pushrod assembly includes a cantilever support arm made of a resilient material and attached at a first end to the interior surface of the keypad cover and at a second end to the pushrod itself. The support arm retains the pushrod in the aperture. With the keypad cover in its first preselected position, user-provided force on the external end surface of the pushrod moves the pushrod by deflecting the support arm. This causes the interior end surface to press against the preselected key surface and operate its associated switch. The resiliency of the support arm urges the pushrod away from the key surface when force is no longer applied to its external end surface.

Our new design for the pushrod assembly reduces misalignment between the pushbutton and the aperture, simplifies the process of attaching the pushrod assembly to the cover, and reduces during operation the maximum tensile load on the material which attaches such a support arm to the cover. The improved elements of the design include in the pushrod assembly a cantilever brace arm, said brace arm having a first end unitary with the first end of the cantilever support arm. The brace arm lies generally along the cantilever support arm with a second end spaced apart from the support arm and attached to the interior surface of the keypad cover. That is, the brace arm is folded back to lie along the support arm, and tensile stress is transferred from the attachment point of the support arm, to the second end of the brace arm's attachment to the interior surface of the cover. This arrangement at the same time substantially reduces the maximum tensile stress to which the attachment between the pushrod assembly and the cover is subjected. At the same time, the maximum spacing between the attachment points is substantially increased, allowing the pushrod assembly to maintain the registration of the pushrod more accurately in the aperture, reducing the possibility of friction between the pushrod or pushbutton surface and the aperture's periphery.

BRIEF DESCRIPTION OF THE DRAWINGS

FIG. 1 is a perspective view of the interior surface of a keypad cover incorporating the invention.

FIG. 2 is a perspective view of the exterior surface of a keypad cover incorporating the invention.

FIG. 3 is a perspective view of a pushrod assembly exploded from adjacent elements of the cover from their interior side.

FIG. 4 is a perspective of the pushrod assembly as viewed from its external side.

DESCRIPTION OF THE PREFERRED EMBODIMENTS

Figure 5:
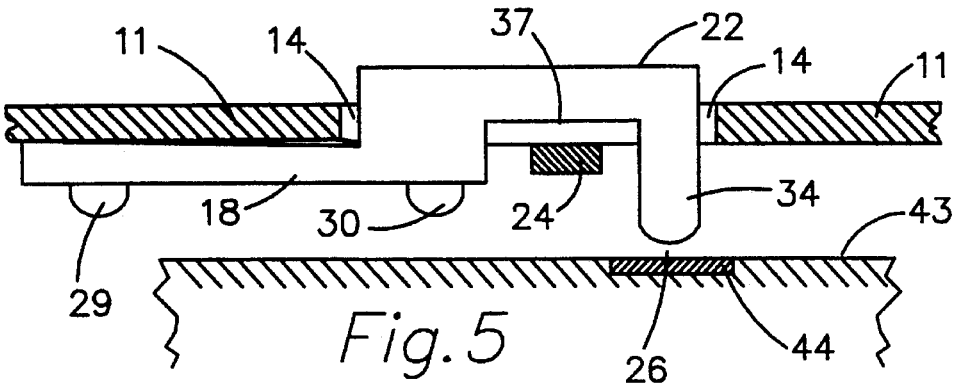
FIG. 5 is a cross section view of the pushrod assembly and the keypad when the pushbutton shown is unactuated.

The operating functions of the invention can be learned from FIGS. 1 and 2 which show a pair of pushbuttons 21 and 22 mounted in a cover assembly 10 for the keypad of an electronic device such as a thermostat. Cover assembly 10 includes a cover 11 having an aperture 12 through which a digital display may be viewed when the cover 11 is covering the keypad. Cover assembly 10 also includes a pushrod assembly 15 of which pushbuttons 21 and 22 form a part. Either pushbutton 21 or 22 can be pressed by a user to slightly shift pushbutton 21 or 22 to depress a keypad surface supported close to the interior surface of cover assembly 10 shown in FIG. 1.

Pushrod assembly 15 is shown in larger scale in FIGS. 3 and 4. Pushrod assembly 15 includes pushrods 33 and 34 which respectively pass through the apertures 13 and 14 of cover 11. The topology of apertures 13 and 14 match the cross-sectional shapes of pushrods 33 and 34 where they pass through cover 11. Pushrods 33 and 34 are each integral with a cantilever support arm 18 at a first end thereof, and are supported thereby in apertures 13 and 14 of cover 11. The pushbuttons 21 and 22 each form an exterior end surface of pushrods 33 and 34 and surfaces 26 form interior end surfaces of pushrods 33 and 34. We prefer to radius each surface 26 as shown to prevent excessive pressure on the keypad surface or switch beneath which may cause damage to either of them. Each support arm 18 is formed of a resilient material and is integral at a second end thereof with an attachment pad 23 forming one of the attachment areas between the pushrod assembly 15 and cover 11.

A cantilever brace arm 19 is provided which lies generally along the support arms 18 with its first end integral with the attachment pad 23 and its second end generally between the pushbuttons 21 and 22. Plastic rivets 29–31 integral with the cover 11 are arranged to align with three mounting holes 39–41 provided in pushrod assembly 15. During assembly, rivets 29–31 are inserted into holes 39–41 and are then staked to attach pushrod assembly 15 to cover 11, thereby forming cover assembly 10. Stop bars or members 24 integral with cover 11 extend across interior surfaces of pushrods 33 and 34 to limit their travel and prevent damage to support arms 18 caused by excessive travel of pushrods 33 and 34. Stop bars 24 in essence divide apertures 13 and 14 each into first and second areas, wherein the first area of each is adjacent to the first end of the adjacent support arm 18, and the pushrod 33 or 34 passes through the associated second area. For esthetic purposes, the cross section of pushbuttons 21 and 22 within apertures 13 and 14 closely match the shape of apertures 13 and 14.

Figure 6:
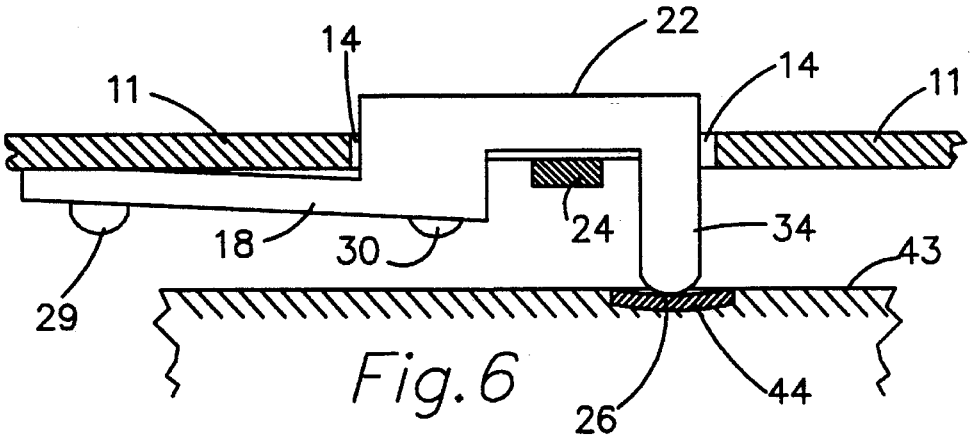
FIG. 6 is a cross section view of the pushrod assembly and the keypad when the pushbutton shown is actuated.

FIGS. 5 and 6 show in a cross section view the relative topology and dimensions of the pushrod assembly 15 and an adjacent keypad 43. A keypad surface 44 in alignment with aperture 14 and pushrod 34 is shown as a part of keypad 43. A clearance space is provided between an interior surface 37 of each of the pushbuttons 21 and 22, and the exteriorly facing surfaces of each of the stop bars 24. This clearance space should be sufficient to allow travel of pushrod 34 (and 33) for a distance which deflects keypad surface 44 sufficiently to actuate the associated switch, and should therefore be substantially larger than any clearance space between pushrod 26 and the keypad surface 44. FIG. 5 shows the pushbutton 22 in normal position with a clearance space between surface 37 and stop bar 24. FIG. 6 shows pushbutton 22 operated to the limit imposed by the stop bar 24, and keypad surface 44 deflected so as to actuate its associated switch. The stop bar 24 discourages a user from pressing a pushbutton 21 and 22 so hard as to damage the associated switch, or from inadvertently overbending the cantilever support arm 18 supporting the pushbuttons whether the cover assembly 10 is in its first or second position.

The brace arm 19 in cooperation with rivet 30 maintains the alignment of pushbuttons 21 and 22 in apertures 13 and 14 much better than can rivets 29 and 31 alone, thereby substantially reducing the likelihood of friction or binding between the edges of apertures 13 or 14 on the one hand and pushbuttons 21 or 22 on the other. Brace arm 19 and rivet 30 also reduce the stress on rivets 29 and 31 during operation of a pushbutton, avoiding in large part the possibility that rivets 29 and 31 might fail, which would allow pushrod assembly 15 to malfunction in use. Further, brace arm 19 reduces the criticality of the positional dimensions of holes 39–41 and rivets 29–31, thereby improving the manufacturability of the cover assembly 10.

As can be seen from FIGS. 4–6, support arms 18 and brace arm 19 are relatively long compared to their thickness and width, and all are unitary with attachment pad 23. Their cross sectional shapes are approximately constant along their lengths so as to distribute bending in them and avoid concentrated stresses in the material which comprises them during actuation of push buttons 21 and 22.

Figure 7:
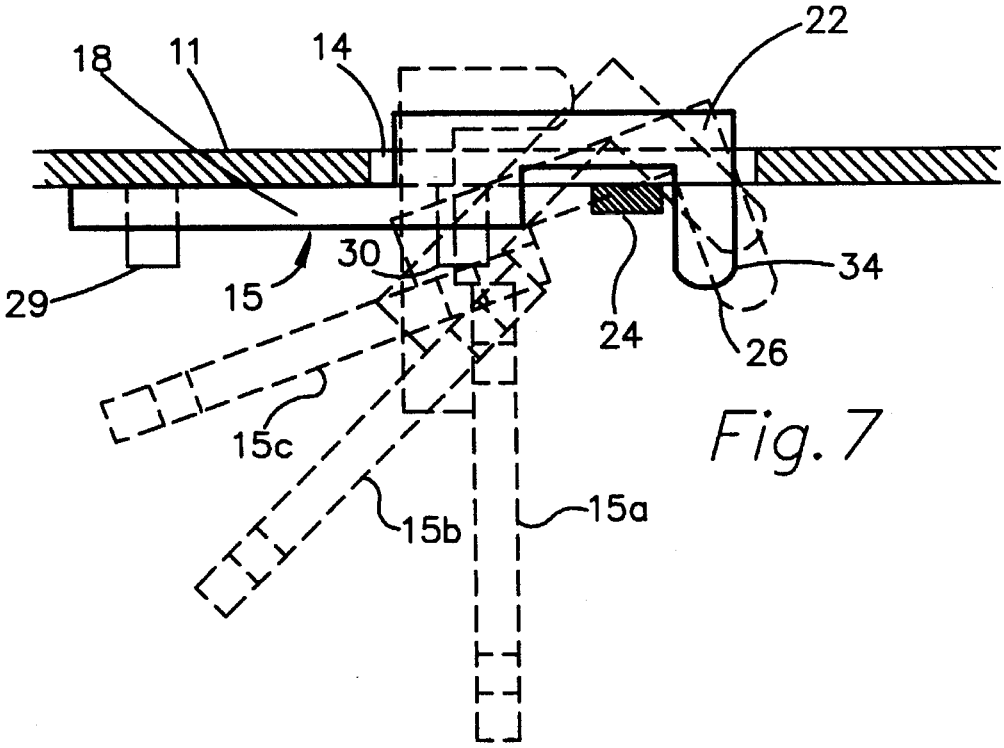
FIG. 7 is a cross section view showing in dotted outline, positions which the pushrod assembly passes through while being attached to the cover.

FIG. 7 shows positions which occur when attaching pushrod assembly 15 to cover 11. Assembly 15 is rotated counterclockwise about a transverse axis from the position shown as outline 15*a* with pushrod 34 (and 33 concealed behind pushrod 34) entering the first area of apertures 13 and 14 to the position of outline 15*b* where surface 26 is just entering the second area of apertures 13 and 14. Continuing the rotation causes pushrod assembly 15 to reach the position of outline 15*c* which indicates the relative dimensions of aperture 14 and the combination of pushbutton 22 and pushrod 34 allowing assembly in this manner. The final position of pushrod assembly 15 is shown in solid outline before the individual rivets 29–31 have been staked, the step which is then taken to attach assembly 15 permanently to cover 11. The reader should note that this assembly process of rotating pushrod assembly 15 into apertures 13 and 14 is necessary only because stop element 24 is molded into the cover 11. The presence of brace arm 19 has nothing to do with this assembly process.

The embodiments of the invention in which an exclusive property or right is claimed are defined as follows:

1. In apparatus having a housing including a housing panel in which is a depressible key surface, and a cover having an interior surface and an exterior surface, said cover mounted on the housing and movable thereon from a first preselected position covering the key surface with the cover's interior surface facing the key surface, to a second preselected position exposing and allowing access to the key surface, wherein the cover has an aperture in alignment with the key surface when the keypad cover is in its first preselected position, said cover including a pushrod assembly allowing the key surface to be depressed with the cover in its first preselected position, said pushrod assembly comprising a pushrod in the aperture and projecting from the interior surface of the cover, and a cantilever support arm having first and second ends and made of a resilient material, said support arm attached at the first end thereof to the interior surface of the cover and at the second end thereof to the pushrod, whereby external pressure on the pushrod deflects the support arm and when the cover is in its first preselected position presses the pushrod against the key surface, wherein the improvement includes in the pushrod assembly a cantilever brace arm, said brace arm having a first end integral with the first end of the cantilever support arm, said brace arm lying generally along and spaced from the cantilever support arm and having a second end spaced apart from the support arm and attached to the interior surface of the cover.

2. The apparatus of claim 1, wherein the pushrod assembly includes an attachment pad fixed to the interior surface of the keypad cover and integral with the first ends of the support arm and the brace arm.

3. The apparatus of claim 2, including a stop member attached to the interior surface of the keypad cover and transversely crossing the support arm.

4. The apparatus of claim 3, wherein the aperture has an elongate shape extending along the support arm, and wherein the support arm includes an area facing and in alignment with the stop member, and wherein the stop member divides the aperture into a second area through which the pushrod passes and a first area between the second area and the attachment pad adjacent to the support arm, said support arm and pushrod having a shape and cross section allowing the pushrod to pass through the aperture's first area, and the pushrod to enter the second area.

5. The apparatus of claim 4, wherein the support arm includes a push button projecting through the exterior surface of the cover, said push button having a periphery whose shape substantially matches the periphery of the aperture.

6. A method for assembling the keypad cover of claim 4, comprising a) inserting the pushrod into the second area from the interior surface to the exterior surface of the keypad cover;

b) rotating the pushrod assembly about a transverse axis into its assembled position; and c) fixing the attachment pad and the brace arm to the interior surface of the keypad cover.

7. The apparatus of claim 5 wherein the pushrod assembly is unitarily formed.

8. The apparatus of claim 3, wherein the keypad cover and the stop are unitarily formed.

9. The apparatus of claim 1, wherein the support arm is relatively long in comparison to its thickness, and wherein wherein the thickness is approximately constant along a substantial portion of the length thereof.

10. The apparatus of claim 1, wherein the cover includes at least first and second mounting rivets projecting from the interior surface of the cover, and an area of the support arm's first end has a mounting hole within which is the first mounting rivet, and an area of the brace arm's second end has a mounting hole within which is the second mounting rivet.

11. A push button support assembly for resiliently mounting a push button on a surface, said push button having a first surface for manual operation and a second surface for providing force to a controlled element, said assembly including a cantilever support arm having first and second ends and made of a resilient material, said support arm attached at the first end thereof to the surface of the keypad cover and at the second end thereof to the push button, whereby external pressure on the push button deflects the support arm, wherein the improvement includes in the support assembly a cantilever brace arm, said brace arm having a first end integral with the first end of the cantilever support arm, said brace arm lying generally along and spaced from the cantilever support arm and having a second end spaced apart from the support arm and attached to the surface.

12. The apparatus of claim 11, wherein the support assembly includes an attachment pad fixed to the surface and integral with the first ends of the support arm and the brace arm.

13. The apparatus of claim 12, wherein the push button and the support assembly are unitarily formed.

14. The apparatus of claim 11, wherein the support arm is relatively long in comparison to the thickness thereof, and wherein the thickness is approximately constant along a substantial portion of the length thereof.

15. The apparatus of claim 11, further comprising at least first and second mounting rivets projecting from the surface, an area of the support arm's first end having a mounting hole into which projects the first mounting rivet and an area of the brace arm's second end having a mounting hole into which projects the second mounting rivet.

* * * * *

UNITED STATES PATENT AND TRADEMARK OFFICE

CERTIFICATE OF CORRECTION

PATENT NO. : 5,552,956

DATED : September 3, 1996

INVENTOR(S) : Pasquarette et al.

It is certified that error appears in the above-indentified patent and that said Letters Patent is hereby corrected as shown below:

Column 6, line 31, insert --support-- before "surface".

line 36, cancel "attached" and substitute --attachable--; insert --support-- before "surface"; cancel "of the keypad"

line 37, cancel "cover".

line 44, cancel "attached" and substitute --attachable--; insert --support-- after the second occurrence of "the".

line 47, cancel "fixed" and substitute --fixable--.

line 57, insert --support-- before "surface".

Signed and Sealed this

Fourth Day of February, 1997

*Attest:*

*Attesting Officer*

BRUCE LEHMAN

*Commissioner of Patents and Trademarks*